US009644569B2

(12) United States Patent
Mitsui et al.

(10) Patent No.: US 9,644,569 B2
(45) Date of Patent: May 9, 2017

(54) BOOT SEAL FOR VARIABLE COMPRESSION RATIO ENGINE

(71) Applicants: TOYODA GOSEI CO., LTD., Kiyosu-shi, Aichi-ken (JP); TOYOTA JIDOSHA KABUSHIKI KAISHA, Toyota-shi, Aichi-ken (JP)

(72) Inventors: Kenichi Mitsui, Kiyosu (JP); Tadanobu Ota, Kiyosu (JP); Yoshiki Shimoda, Kiyosu (JP); Kaoru Ito, Okazaki (JP)

(73) Assignees: TOYODA GOSEI CO., LTD., Aichi-pref. (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/591,442

(22) Filed: Jan. 7, 2015

(65) Prior Publication Data

US 2015/0192090 A1 Jul. 9, 2015

(30) Foreign Application Priority Data

Jan. 8, 2014 (JP) ..... 2014-001595
Nov. 27, 2014 (JP) ..... 2014-240244

(51) Int. Cl.
*F02F 11/00* (2006.01)
*F02B 75/04* (2006.01)

(52) U.S. Cl.
CPC ..... *F02F 11/002* (2013.01); *F02B 75/04* (2013.01)

(58) Field of Classification Search
CPC ..... F16J 15/36; F16J 15/38; F02F 11/002
(Continued)

(56) References Cited

U.S. PATENT DOCUMENTS 5,466,084 A * 11/1995 Brueggen ..... F16C 11/0671 277/635
8,936,248 B2 1/2015 Mitsui et al.
(Continued)

FOREIGN PATENT DOCUMENTS

CN 102705104 A 10/2012
JP 11-188757 A 7/1999
JP 2012-202371 A 10/2012

OTHER PUBLICATIONS

Office Action issued Oct. 10, 2016 in the corresponding CN application No. 201510009514.8.

*Primary Examiner* — Kristina Fulton
*Assistant Examiner* — L. Susmitha Koneru
(74) *Attorney, Agent, or Firm* — Posz Law Group, PLC

(57) ABSTRACT

Provided is a boot seal for a variable compression ratio engine having an inner layer free from tears or creases. The boot seal comprises a boot body having a cylinder-attaching part, a crankcase-attaching part and a connecting part for connecting these parts, and a rigid plate disposed in at least one of the cylinder-attaching part and the crankcase-attaching part and having a through hole. The boot body comprises an outer layer formed by injection molding a rubber material, and an inner layer formed of fluorine-containing rubber. An injection gate for the outer layer is located at a portion of the outer layer opposing the rigid plate. Both an outer surface and an inner surface of at least a portion of the rigid plate having the through hole are covered with the rubber material supplied from the injection gate.

13 Claims, 6 Drawing Sheets

(58) Field of Classification Search
USPC ..... 277/634–637
See application file for complete search history.

(56) References Cited

U.S. PATENT DOCUMENTS

2006/0049584 A1* 3/2006 Sueoka ..... B29C 45/14336
277/635
2012/0248712 A1* 10/2012 Mitsui ..... F02B 75/041
277/596
2013/0037397 A1* 2/2013 Tittle ..... H01H 13/06
200/302.2

* cited by examiner

BOOT SEAL FOR VARIABLE COMPRESSION RATIO ENGINE

FIELD OF THE INVENTION

The present invention relates to a boot seal for use with a variable compression ratio engine.

BACKGROUND OF THE INVENTION

Variable compression ratio (VCR) engines capable of varying the compression ratio of an air-fuel mixture gas to meet driving conditions of a vehicle are a known technology. The VCR engines can extract more torque by increasing the compression ratio under low load and can suppress knocking by decreasing the compression ratio under high load.

One technique of varying the compression ratio of the air-fuel mixture gas, that is, the ratio of a maximum to a minimum volume of a combustion chamber in a cylinder obtained by vertical movement of a piston is to change relative positions of a cylinder block and a crankcase by moving at least one of these components.

Here, the air-fuel mixture gas in the combustion chamber sometimes leaks out from a gap between the piston and the cylinder in the engine into the crankcase, etc. The leaked mixture gas is commonly called blowby gas and contains unburned fuel. The blowby gas is returned to an intake pipe through a crank chamber in the crankcase.

However, if the relative positions of the cylinder block and the crankcase are changed as mentioned above, the blowby gas, engine oil, etc. may flow out of the engine from a gap between the cylinder block and the crankcase and scatter and cause such problems as contamination of an engine-surrounding area and corrosion of metal parts around the engine.

As disclosed by Japanese Patent No. 5,313,284, that is, Japanese Unexamined Patent Publication No. 2012-202, 371, it has been proposed to cover the gap between the cylinder block and the crankcase with an extendable tubular boot seal having a two-layer rubber structure. This boot seal comprises an outer layer formed of ethylene acrylic rubber and an inner layer formed of fluorine-containing rubber. The use of fluorine-containing rubber having good resistance to heat, oil and chemicals as an inner layer prevents the boot seal from degradation even when the boot seal is exposed to blowby gas.

However, the inner layer formed of fluorine-containing rubber is made thin for the sake of cost reduction. When a thin fluorine-containing rubber sheet is placed in a mold and ethylene acrylic rubber is injection molded on an outside of the sheet, a portion of the fluorine-containing rubber layer near an injection gate tears easily due to high injection pressure, and a portion of the fluorine-containing rubber layer where flows of the molten material join together creases easily. If the fluorine-containing rubber layer tears, the blowby gas will contact the outer layer rubber through a torn portion and impair durability of the outer layer rubber.

Moreover, Japanese Unexamined Patent Application Publication No. H11-188,757 discloses a method for forming an instrument panel having a two-layer structure by injection molding. A surface skin is placed in a cavity of a mold and then foamed resin is injection molded. In the technique of Patent Document 2 as well as the technique of Patent Document 1, injection pressure is applied on the surface skin and may tear or crease the surface skin.

SUMMARY OF THE INVENTION

The present invention has been made in view of the abovementioned circumstances. It is an object of the present invention to provide a VCR engine boot seal having an inner layer free from tears or creases.

(1) A boot seal for use with a VCR engine according to the present invention is a boot seal attached to a VCR engine capable of varying volume of a combustion chamber by changing relative positions of a cylinder block and a crankcase, covering a gap between the cylinder block and the crankcase, and comprising a boot body having a cylinder-attaching part to be fixed to the cylinder block, a crankcase-attaching part to be fixed to the crankcase, and a connecting part for connecting the cylinder-attaching part and the crankcase-attaching part; and a rigid plate disposed in at least one of the cylinder-attaching part and the crankcase-attaching part and having a through hole, the boot body comprising an outer layer formed by injection molding a rubber material, and an inner layer disposed inside the outer layer and formed of fluorine-containing rubber, an injection gate for the outer layer being located at a portion of the outer layer opposing the rigid plate, and both an outer surface and an inner surface of at least a portion of the rigid plate having the through hole being covered with the rubber material supplied from the injection gate.

An inner side of the boot body is constituted by an inner layer formed of fluorine-containing rubber. Fluorine-containing rubber has good resistance to heat, oil and chemicals. Therefore, even if an inner surface of the boot seal is exposed to blowby gas, degradation of the boot seal is suppressed.

An outer layer of the boot body is formed of a material except fluorine-containing rubber. Owing to this construction, the amount of fluorine-containing rubber used in the entire boot seal is reduced and costs of the boot seal can be kept low.

A rigid plate is disposed in at least one of a cylinder-attaching part and a crankcase-attaching part. Since the rigid plate is disposed in at least one of the cylinder-attaching part and the crankcase-attaching part, the at least one of the cylinder-attaching part and the crankcase-attaching part attains high rigidity and accordingly increases strength in attachment to the cylinder block and/or the crankcase.

For formation of the outer layer, a rubber material is supplied from an injection gate into a cavity of a mold with fluorine-containing rubber to serve as the inner layer inserted in the cavity of the mold beforehand. The injection gate for forming the outer layer is located at a portion of the outer layer opposing the rigid plate. In injection molding the outer layer, the rubber material supplied from the injection gate hits the rigid plate. Upon hitting the rigid plate, the rubber material reduces or disperses its injection pressure. Therefore, injection pressure which the inner layer receives form the rubber material for forming the outer layer is reduced and positional displacement or tears of the inner layer is prevented.

The rubber material supplied from the injection gate flows around from one of an outer surface and an inner surface of a portion of the rigid plate having a through hole to the other through the through hole of the rigid plate. In regard to an outer surface and an inner surface of each of the cylinder-attaching part and the crankcase-attaching part, the term "inner surface" used herein refers to a surface connected continuously to an inner circumferential surface of a connecting part which faces in a radially inward direction of the boot seal. The term "outer surface" refers to an opposite surface to the inner surface of each of the cylinder-attaching part and the crankcase-attaching part. An inner surface of the rigid plate means a surface facing the inner surface of the cylinder-attaching part and/or the crankcase-attaching part connected continuously to the inner circumferential surface of the connecting part. An outer surface of the rigid plate means a surface facing the outer surface of the cylinder-attaching part and/or the crankcase-attaching part. The inner surface and the outer surface of the rigid plate are covered with the outer layer. The inner surface of the rigid plate faces the inner layer with the outer layer interposed therebetween.

Both an outer surface and an inner surface of at least a portion of the rigid plate having the through hole are covered with the rubber material for forming the outer layer. The rubber material for forming the outer layer enters the through hole formed in the rigid plate. Therefore, the rigid plate is securely fixed to the outer layer. Fluorine-containing rubber to serve as the inner layer is pressed down against a mold surface by the rubber material which has flown around from a side of the outer surface to a side of the inner surface of the rigid plate through the through hole of the rigid plate. Therefore, the inner layer is held by the rubber material in a relatively early stage of injection molding. The inner layer is suppressed from being displaced by injection pressure of the rubber material.

Thus, the injection pressure of the rubber material is reduced by the rigid plate and the inner layer is held by the rubber material in a relatively early stage of injection molding. Therefore, the inner layer hardly tears or creases.

(2) Preferably, the injection gate is located in the portion of the outer layer opposing a surface of the rigid plate except an opening of the through hole.

The rubber material injected from the injection gate hits the rigid plate and reduces its injection pressure and then flows along the rigid plate. The rubber material which has reduced its injection pressure enters the through hole of the rigid plate. Then the rubber material under a low pressure flows into a gap between an inner surface of the rigid plate and the inner layer through the through hole. Fluorine-containing rubber is not positionally displaced or torn by flow of the rubber material.

(3) Preferably, an inner surface of a portion of the outer layer opposing the through hole of the rigid plate faces the inner layer.

In injection molding the outer layer, the rubber material for forming the outer layer flows around to a side of the inner surface of the rigid plate through the through hole. The rubber material having flown around to the side of the inner surface of the rigid plate presses down the inner layer against a mold surface surrounding a cavity of a mold. The inner layer is not positionally displaced by the flow of the rubber material.

The rubber material which has been supplied from the injection gate, hit the rigid plate and reduced its injection pressure flows into the through hole. The rubber material which has flown around to the side of the inner surface of the rigid plate through the through hole has a relatively small injection pressure and does not tear the fluorine-containing rubber.

(4) Preferably, a peripheral portion of the rigid plate has a receiving portion bent toward the connecting part, and the injection gate is located at a portion of the outer layer opposing the receiving portion.

The rubber material supplied from the injection material hits the receiving portion formed at the peripheral portion of the rigid plate. Part of the rubber material flows along the rigid plate and forms at least one of the cylinder-attaching part and the crankcase-attaching part. Some other part of the rubber material flows toward the connecting part. Flow rate of the rubber material flowing into a portion to form the at least one of the cylinder-attaching part and the crankcase-attaching part and flow rate of the rubber material flowing into a portion to form the connecting part can be controlled by adjusting a direction or angle of the receiving portion with respect to the connecting part. Thus, the rubber material supplied from the injection gate can be fast and uniformly flown into the entire cavity of the mold.

(5) Preferably, the inner layer is formed by injection molding the fluorine-containing rubber. When the inner layer is formed by wrapping a mold surface with a fluorine-containing rubber sheet, for example, as disclosed by Japanese Patent No. 5,313,284, the inner layer is formed by overlaying one of a wrapping start portion and a wrapping end portion of the sheet on the other. In this case, there is a risk that width of an overlapping portion may be insufficient and a gap may be formed between the wrapping start portion and the wrapping end portion. Blowby gas may enter through the gap and may cause the outer layer to degrade. However, upon forming the inner layer by injection molding, the inner layer attains a gap-free thin film shape. This suppresses degradation of the boot seal due to blowby gas and reduces costs of the boot.

(6) Preferably, an inner surface of the inner layer has an uneven portion. Since the uneven portion of the inner layer gets engaged with a mold cavity surface, positional displacement of the inner layer is prevented. The inner layer is securely prevented from tearing or creasing.

An uneven portion formed on the inner layer can have any shape as long as it allows the inner layer to be held by an inner surface of a mold, and can be, for example, a textured surface or a surface having patterned protrusions and indentions formed by knurling. As depth of the indentions from the protrusions is greater, and as the protrusions and the indentions have a smaller pitch, it is more preferable in view of prevention of positional displacement because the uneven portion of the inner layer gets more firmly engaged with the mold cavity surface. However, an excessively great depth makes mold releasing difficult. Therefore, it is preferable that the depth of the indentions from the protrusions, i.e., a difference in height between the protrusions and the indentions of the uneven portion is 0.01 to 0.5 mm. It is also preferred that the protrusions and the indentions have a pitch of 0.1 to 10 mm.

A major advantageous effect of the present invention is as follows. In the present invention, the injection gate for the outer layer is located at the portion of the outer layer opposing the rigid plate, and the outer surface and the inner surface of at least the portion of the rigid plate having the through hole are covered with the rubber material constituting the outer layer. Therefore, the present invention can provide a boot seal for use with a VCR engine having an inner layer free from tears or creases.

BRIEF DESCRIPTION OF THE DRAWINGS

Other objects and features of the present invention will become apparent to those skilled in the art as the disclosure is made in the following description of preferred embodiments of the present invention, as illustrated in the accompanying drawings in which.

DETAILED DESCRIPTION OF THE PREFERRED EMBODIMENTS

First Preferred Embodiment

Figure 1:
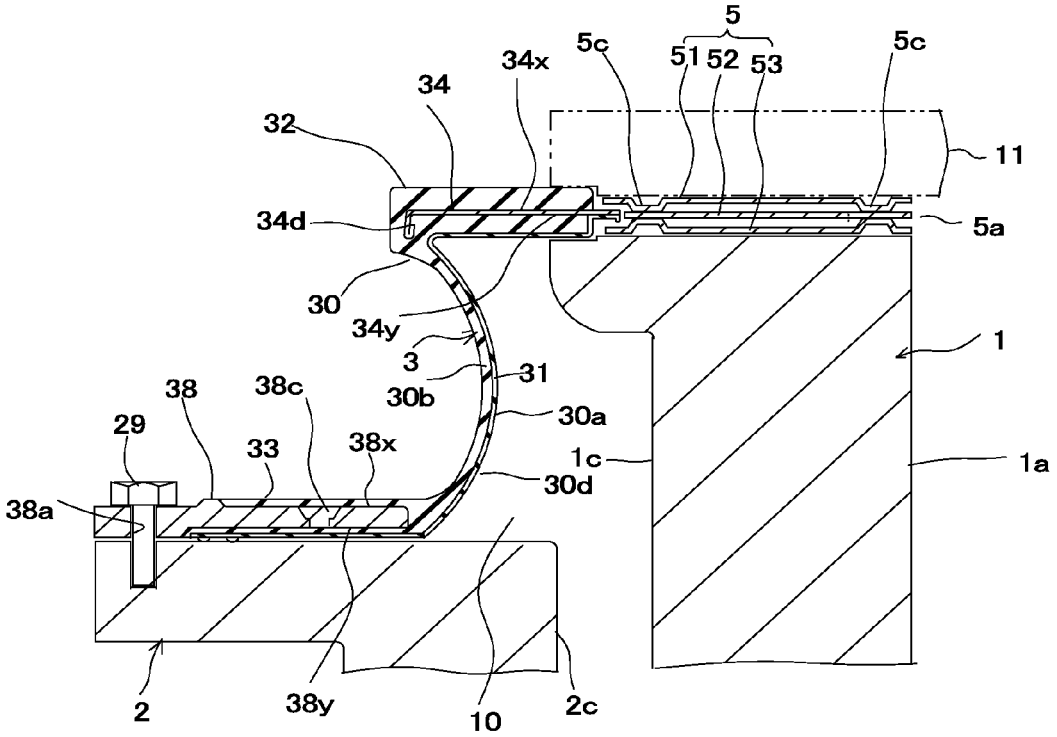
FIG. 1 is a cross-sectional view, taken along the line between the arrows A, A of FIG. 2, of a boot seal according to a first preferred embodiment of the present invention.

A first preferred embodiment of the present invention will be described with reference to FIGS. 1 to 9. As shown in FIG. 1, a boot seal for use with a VCR engine according to the present embodiment is a boot seal 3 attached to a VCR engine which varies the compression ratio by vertically changing relative positions of a cylinder block 1 and a crankcase 2 and covering a gap 10 between the cylinder block 1 and the crankcase 2.

The cylinder block 1 has a roughly solid rectangular parallelepiped shape and is placed in the crankcase 2 having a rough box shape. The cylinder block 1 is movable in a perpendicular direction to the crankcase 2. An outer circumferential surface 1*c* of the cylinder block 1 opposes an inner circumferential surface 2*c* of the crankcase 2 with a gap 10 therebetween. Blowby gas leaked from a combustion chamber flows in this gap 10.

Figure 2:
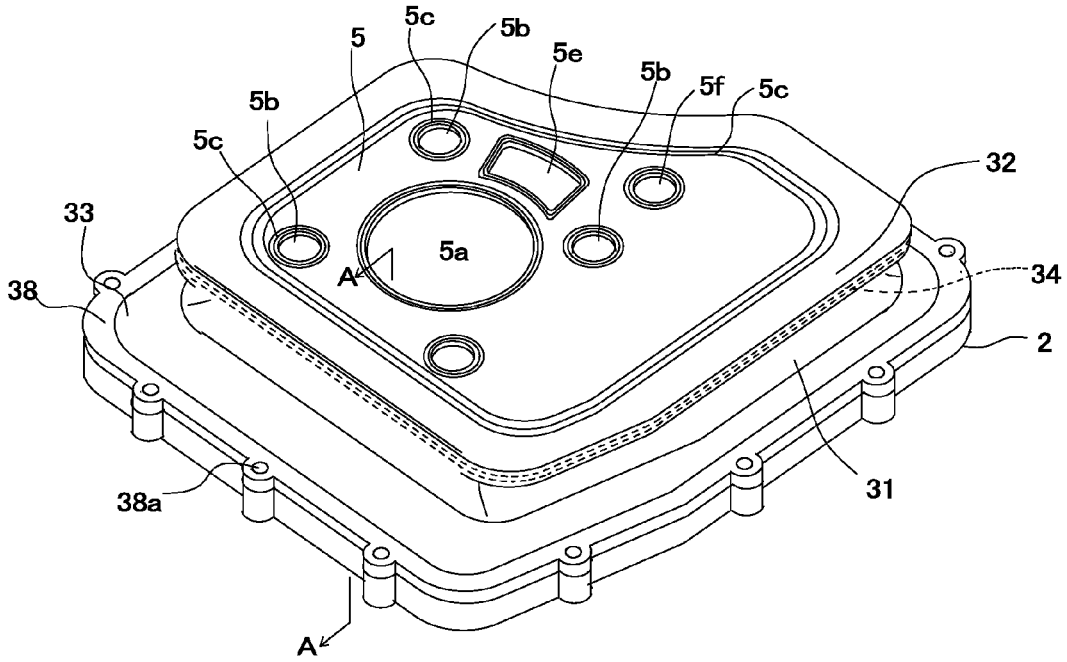
FIG. 2 is a perspective view of the boot seal for the VCR engine according to the first preferred embodiment.

As shown in FIGS. 1 and 2, the cylinder block 1 has one cylindrical part 1*a*. The cylindrical part 1*a* constitutes a cylinder and a piston is placed in the cylinder so as to vertically reciprocate. At an upper portion of the cylindrical part 1*a*, the combustion chamber is formed between a top surface of the piston and a lower surface of a cylinder head 11 mentioned later. The volume of the combustion chamber is repeatedly increased and decreased with repetition of a combustion cycle of compression of an air-fuel mixture gas, explosion, exhaust, and intake of an air-fuel mixture gas. A ratio of a volume of the combustion chamber at a piston bottom dead center to that at a piston top dead center is called a compression ratio.

The crankcase 2 has a rough box shape and a lower portion of the cylinder block 1 is inserted in a crank room, not shown, of the crankcase 2 so as to be movable in a perpendicular direction to the crankcase 2. An upper portion of the crankcase 2 has the shape of a rectangular frame surrounding the cylinder block 1. The piston is located at a position corresponding to the cylindrical part 1*a* in the crank room of the crankcase 2. The cylinder block 1 is moved in the perpendicular direction to the crankcase 2 by moving means such as a camshaft, not shown. A distance of the travel of the cylinder block 1 with respect to the crankcase 2 is about 0 to 15 mm, for instance. When the cylinder block 1 is moved in the perpendicular direction to the crankcase 2, the compression ratio of the combustion chamber formed respectively by the cylindrical part 1*a* of the cylinder block 1, the piston and a lower surface of the cylinder head 11 is also varied. Upon increasing or decreasing the compression ratio of the combustion chamber, driving torque generated by the engine is controlled.

As shown in FIG. 1, the cylinder head 11 is disposed above the cylinder block 1 with a cylinder head gasket 5 formed of stainless steel interposed therebetween.

Upon being sandwiched by the cylinder block 1 and the cylinder head 11, the cylinder head gasket 5 seals between the cylinder block 1 and the cylinder head 11. The cylinder head gasket 5 has a roughly rectangular plate shape of almost the same size as that of a flat upper surface of the cylinder block 1. The cylinder head gasket 5 is formed by stacking an outer metal plate 51 having a thickness of 0.2 to 0.3 mm, a middle metal plate 52 having a thickness of 0.5 to 0.7 mm and an inner metal plate 53 having a thickness of 0.2 t 0.3 mm in this order and clamping the stack together. The outer metal plate 51, the middle metal plate 52 and the inner metal plate 53 are all formed of stainless steel.

As shown in FIG. 2, the cylinder head gasket 5 has a piston opening 5*a* of the same number as that of the cylindrical part 1*a* of the cylinder block 1, bolt holes 5*b* for bolting the cylinder block 1, the boot seal 3 and the cylinder head 11, a water hole 5*e* for a cylinder-surrounding component of an engine cooling system, and an oil hole 5*f* for a cylinder-surrounding component of a lubricating oil system.

As shown in FIGS. 1 and 2, outer peripheral portions of the outer metal plate 51 and the inner metal plate 53, and peripheral portions of the piston opening 5*a*, the bolt holes 5*b*, the water hole 5*e* and the oil hole 5*f* have ring-shaped sealing protrusions 5*c* formed by pressing. The sealing protrusions 5*c* formed on the outer metal plate 51 project downward and the sealing protrusions 5*c* formed on the inner metal plate 53 project upward. Since the sealing protrusions 5*c* of the outer metal plate 51 and the sealing protrusions 5*c* of the inner metal plate 53 sandwich the middle metal plate 52, these sealing protrusions 5*c* elastically deform downward or upward and securely seal between the cylinder block 1 and the cylinder head 11.

The boot seal 3 comprises a boot body 30 and rigid plates 34, 38. The boot body 30 is a two-layer rubber molding having a rectangular-tube shape. The boot body 30 has a cylinder-attaching part 32 to be fixed to the cylinder block 1, a crankcase-attaching part 33 to be fixed to the crankcase 2, and a connecting part 31 for connecting the cylinder-attaching part 32 and the crankcase-attaching part 33.

The connecting part 31 reduces its diameter in a radially inward direction from both axial (vertical) ends toward an axial (vertical) center, and is axially extendable. One axial end (an upper end) of the connecting part 31 is integrally formed with the cylinder-attaching part 32, while the other axial end (a lower end) of the connecting part 31 is integrally formed with the crankcase-attaching part 33.

The cylinder-attaching part 32 is connected to the upper end of the connecting part 31 and extends in a radially inward direction from the upper end of the connecting part 31. The crankcase-attaching part 33 is connected to the lower end of the connecting part 31 and extends in a radially outward direction from the lower end of the connecting part 31.

The boot body 30 comprises an outer layer 30*b* and an inner layer 30*a* disposed inside the outer layer 30*b*.

The outer layer 30*b* constitutes outer sides of the connecting part 31, the cylinder-attaching part 32 and the crankcase-attaching part 33 of the boot body 30. The inner layer 30*a* constitutes inner sides of the connecting part 31, the cylinder-attaching part 32 and the crankcase-attaching part 33 of the boot body 30.

The outer layer 30*b* is formed of a rubber material. The rubber material constituting the outer layer 30*b* is ethylene acrylic rubber (AEM) in the present embodiment. However, the rubber material constituting the outer layer 30*b* is not limited to AEM and can be a rubber such as acrylic rubber (ACM) and silicone rubber, and thermoplastic elastomers.

The inner layer 30*a* is formed of fluorine-containing rubber. Examples of the fluorine-containing rubber include one selected from fluororubbers such as vinylidene-fluoride-based rubber (FKM), tetrafluoroethylene-propylene-based rubber (FEPM), and tetrafluoroethylene-perfluorovinyl-ether-based rubber (FEKM), and their copolymers. Vinylidene-fluoride-based rubber (FKM) is especially preferred. In the present embodiment, FKM is used as a fluorine-containing rubber constituting the inner layer 30*a*. The inner layer 30*a* covers the entire inner surfaces of the outer layer 30*b* of the cylinder-attaching part 32, the crankcase-attaching part 33, and the connecting part 31. The inner layer 30*a* has a thickness of 0.5 mm at all of the cylinder-attaching part 32, the crankcase-attaching part 33 and the connecting part 31.

The rigid plates 34, 38 are buried in the cylinder-attaching part 32 and the crankcase-attaching part 33 of the boot body 30, respectively. The rigid plate 34 buried in the cylinder-attaching part 32 is a metal plate formed of stainless steel and having a thickness of 0.5 to 0.7 mm and a rectangular ring shape. An outer surface (an upper surface) 34*x* and an inner surface (a lower surface) 34*y* of the rigid plate 34 are covered with the outer layer 30*b* of the cylinder-attaching part 32 of the boot body 30 in a width of 14 to 16 mm. The outer layer 30*b* covering the outer surface (the upper surface) 34*x* of the rigid plate 34 has a thickness of 2 to 5 mm. The outer layer 30*b* covering the inner surface (the lower surface) 34*y* of the rigid plate 34 has a thickness of 2 to 5 mm. An inner peripheral portion of the rigid plate 34 protrudes in a radially inward direction from the outer layer 30*b* of the cylinder-attaching part 32 and is disposed in a vicinity of an outer peripheral portion of the cylinder head gasket 5. An outer peripheral portion of the rigid plate 34 has receiving portions 34*d* bent downward at 90 degrees. A flat portion of the rigid plate 34 has a plurality of vertically penetrating through holes 34*c* around a center in a width direction thereof along an entire circumference thereof.

The rigid plate 38 buried in the crankcase-attaching part 33 is a metal plate formed of aluminum and having a thickness of 4 to 10 mm and a rectangular ring shape. An outer surface (an upper surface) 38*x* and an inner surface (a lower surface) 38*y* of the rigid plate 38 are covered with the outer layer 30*b* of the crankcase-attaching part 33 of the boot body 30 in a width of 8 to 30 mm. The outer layer 30*b* covering the outer surface (the upper surface) 38*x* of the rigid plate 38 has a thickness of 1.5 mm. The outer layer 30*b* covering the inner surface (the lower surface) 38*y* of the rigid plate 38 has a thickness of 1 mm. An inner peripheral portion of the rigid plate 38 is located at an inner peripheral portion of the outer layer 30*b* of the crankcase-attaching part 33. An outer peripheral portion of the rigid plate 38 protrudes in a radially outward direction from an outer peripheral portion of the outer layer 30*b* of the crankcase-attaching part 33. The outer peripheral portion of the rigid plate 38 has bolt holes 38*a* arranged at circumferential intervals. The boot seal 3 is fixed to the crankcase 2 by fastening bolts 29 in the bolt holes 38*a* and threaded portions formed on the crankcase 2.

Figure 3:
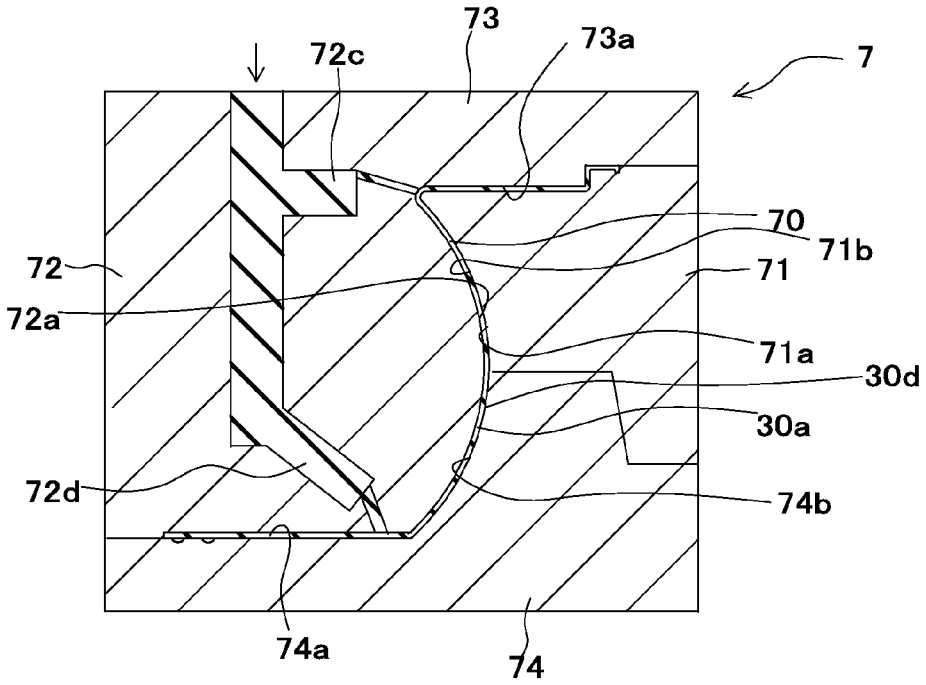
FIG. 3 is a cross-sectional view of a first mold for forming an inner layer of the boot seal according to the first preferred embodiment.

A method for producing the boot seal 3 of the present embodiment will be described. As shown in FIG. 3, a first mold 7 comprising a core 71, an outer mold 72, an upper mold 73 and a lower mold 74 is prepared. The core 71, the outer mold 72, the upper mold 73 and the lower mold 74 have mold surfaces 71*a*, 72*a*, 73*a*, 74*a* having shapes in conformity with an inner surface shape, an outer surface shape, an upper surface shape and a lower surface shape of the inner layer 30*a* of the boot body 30, respectively. Space surrounded by the mold surfaces 71*a*, 72*a*, 73*a*, 74*a* is a cavity 70 having a shape in conformity with a shape of the inner layer 30*a*. Portions of the mold surface 71*a* of the core 71 and the mold surface 74*a* of the lower mold 74 to form the connecting part 31 have uneven portions 71*b*, 74*b* formed by surface texturing, knurling, etc. The uneven portions 71*b*, 74*b* have a depth of 0.05 mm and a pitch of 5 mm.

Figure 4:
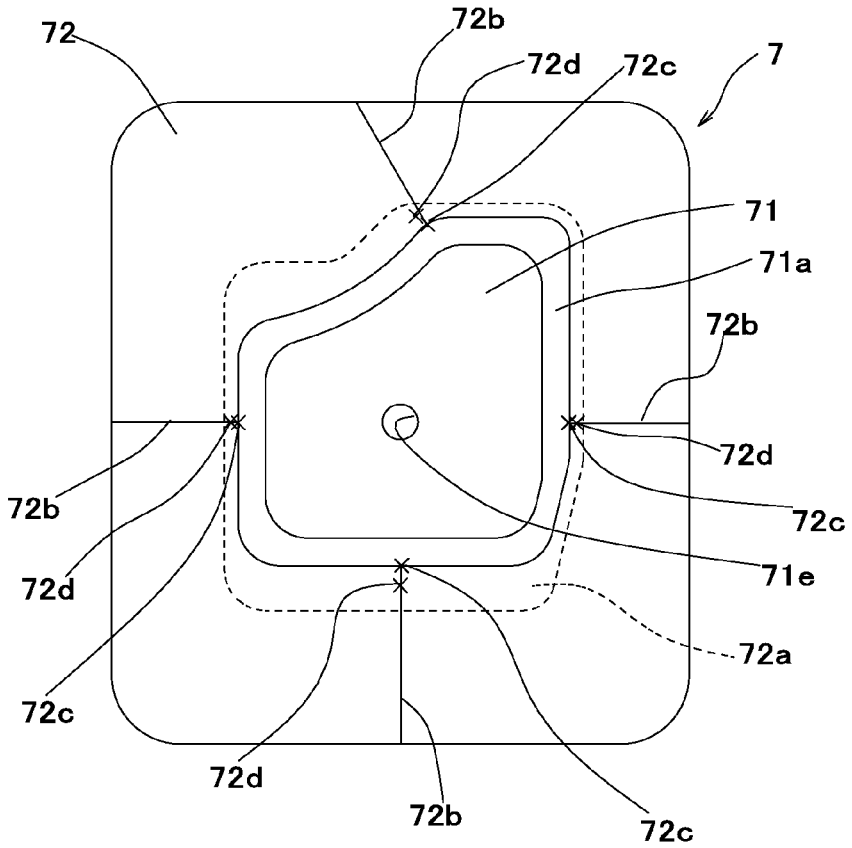
FIG. 4 is an explanatory plan view of the first mold with an upper mold taken away.

As shown in FIG. 4, the outer mold 72 splits into a plurality of sections in a circumferential direction of the inner layer 30*a* and these sections form the mold surface 72*a* having a shape in conformity with the outer surface shape of the inner layer 30*a* when the first mold 7 is closed. Parting lines 72*b* of the plurality of sections of the outer mold 72 are located near centers of respective four sides of the rectangular-tube-shaped inner layer 30*a*. Injection gates 72*c*, 72*d* are respectively provided at positions marked with X in FIG. 4 in the parting lines 72*b*. The injection gates 72*c* are located at portions of the cavity 70 to form the cylinder-attaching part 32, while the injection gates 72*d* are located at portions of the cavity 70 to form the crankcase-attaching part 33.

As shown in FIGS. 3 and 4, an unvulcanized FKL material as a material of the inner layer 30*a* is supplied into the cavity 70 through the injection gates 72*c*, 72*d*. The FKL material fills up the entire cavity 70 and forms the inner layer 30*a*. Portions of the inner layer 30*a* contacting the uneven portion 71*b* of the core 71 and the uneven portion 74*b* of the lower mold 74 become uneven portions 30*d* having shape, depth and pitch corresponding to those of the uneven portions 71*b*, 74*b*. The FKM material in the cavity 70 to form the inner layer 30*a* is vulcanized by heat of the entire first mold 7.

The first mold 7 is opened when the inner layer 30*a* is semivulcanized. The upper mold 73 is removed and the sections of the outer mold 72 are slid in radially outward directions. Then a lifting hook, not shown, is engaged with a hook hole 71*e* in an upper portion of the core 71 and then lifts and transfers the core 71 together with the inner layer 30*b* to a second mold 8.

Figure 5:
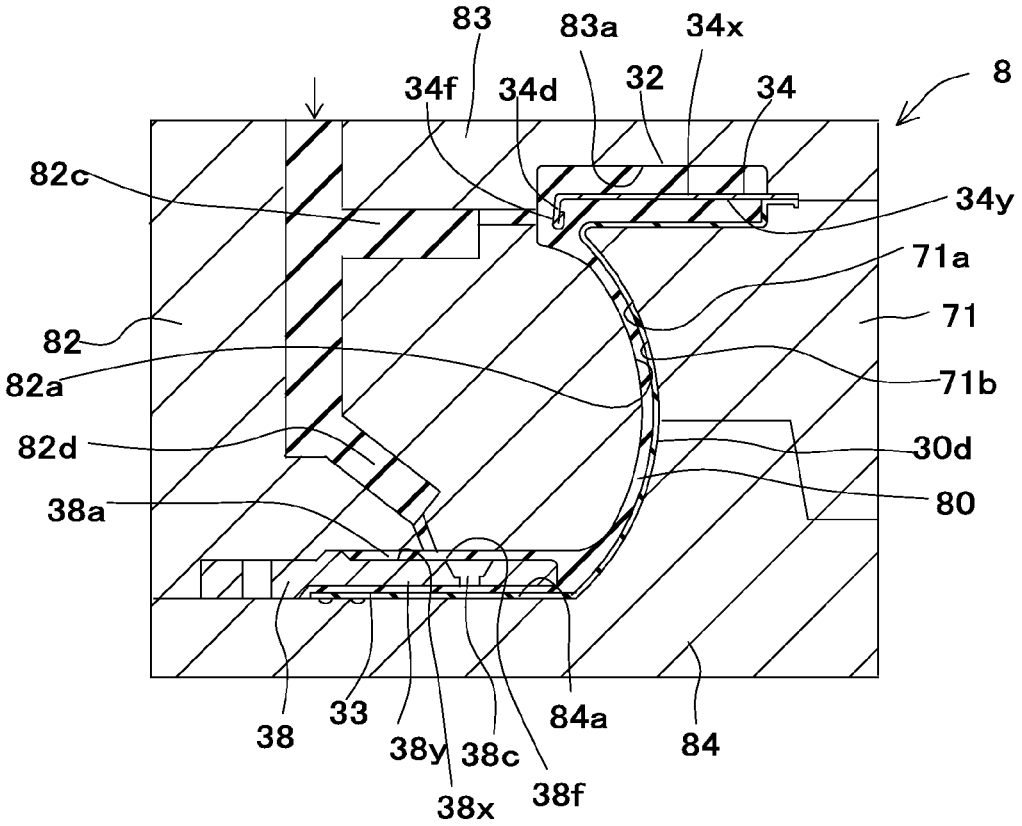
FIG. 5 is a cross-sectional view of a second mold for forming an outer layer of the boot seal according to the first preferred embodiment.

As shown in FIG. 5, the second mold 8 comprises the core 71 used in the first mold 7, an outer mold 82, an upper mold 83 and a lower mold 84. The core 71, the outer mold 82, the upper mold 83 and the lower mold 84 have mold surfaces 71*a*, 82*a*, 83*a*, 84*a* having shapes in conformity with an inner surface shape, an outer surface shape, an upper surface shape and a lower surface shape of the boot seal 3, respectively. Space surrounded by the mold surfaces 71*a*, 82*a*, 83*a*, 84*a* is a cavity 80 having a shape in conformity with a shape of the boot seal 3.

Figure 8:
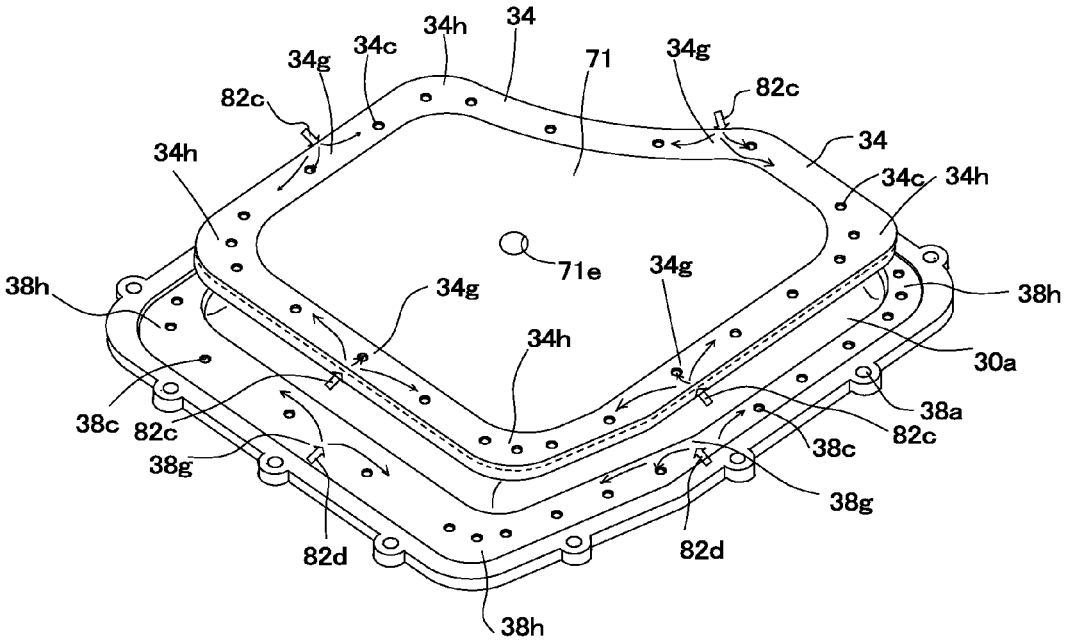
FIG. 8 is a perspective view of rigid plates of the boot seal according to the first preferred embodiment fixed to a core for explanation of flows of an AEM material.

Like the outer mold 72 of the first mold 7 shown in FIG. 4, the outer mold 82 of the second mold 8 splits into a plurality of sections in a circumferential direction of the cavity 80, and the plurality of sections of the outer mold 82 of the second mold 8 have the mold surface 82*a* having a shape in conformity with the outer surface shape of the boot seal 3 when the second mold 8 is closed. As shown in FIGS. 4 and 8, parting lines 82*b* of the plurality of sections of the outer mold 82 are located near centers of respective four sides of the rectangular-tube-shaped outer layer 30*b*. Injection gates 82*c*, 82*d* are provided in each of the parting lines 82*b*. As shown in FIG. 5, the injection gates 82*c* are located at portions of the cavity 80 to form the cylinder-attaching part 32, while the injection gates 82*d* are located at portions of the cavity 80 to form the crankcase-attaching part 33.

After the core 71 is fixed on the lower mold 84, the rigid plates 34, 38 are fixed to the mold surfaces 71*a*, 82*a*, 83*a*, 84*a* which surround the cavity 80. The rigid plate 34 is located at a portion of the cavity 80 to form the cylinder-attaching part 32, while the rigid plate 38 is located at a portion of the cavity 80 to form the crankcase-attaching part 33.

Figure 6:
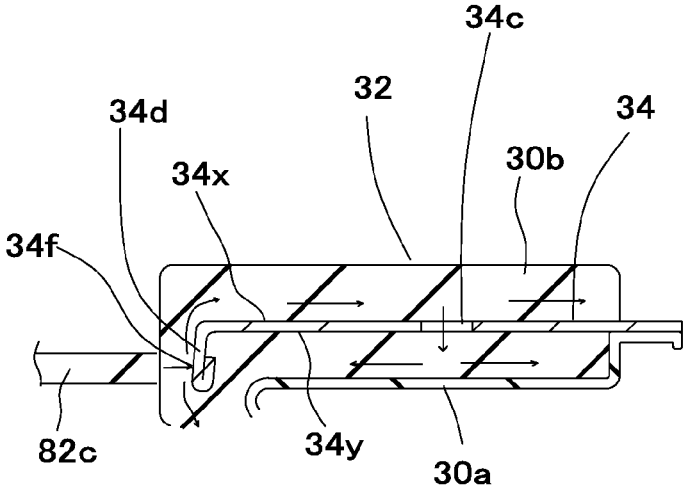
FIG. 6 is an enlarged cross-sectional view of a portion of the second mold to form a cylinder-attaching part.

The outer mold 82 and the upper mold 83 are clamped on the core 71. Then an unvulcanized AEM material is injected from the injection gates 82*c*, 82*d*. Referring to FIGS. 5 and 6, when the AEM material supplied from each of the injection gates 82*c* enters the cavity 80, the AEM material first hits an opposing portion 34*f* of a corresponding receiving portion 34*d* of the rigid plate 34 which opposes that one of the injection gates 82*c*. From the opposing portion 34*f*, the AEM material flows into circumferential, upper and lower directions of the receiving portion 34*d*. The AEM material having flown in the upper direction of the receiving portion 34*d* flows in a planar direction along the outer surface 34*x* of the rigid plate 34 and part of this AEM material flows through the through holes 34*c* of the rigid plate 34 and goes around to a side of the inner surface 34*y*. The AEM material having flown through the through holes 34*c* and gone around to the side of the inner surface 34*y* of the rigid plate 34 flows along the inner surface 34*y* of the rigid plate 34 and fills up a portion of the cavity 80 to form the cylinder-attaching part 32. Thus, the portion of the cavity 80 to form the cylinder-attaching part 32 is filled with the AEM material in a short time. On the other hand, the AEM material having flown in the lower direction of the receiving portion 34*d* flows into a portion of the cavity to form the connecting part 31.

Figure 7:
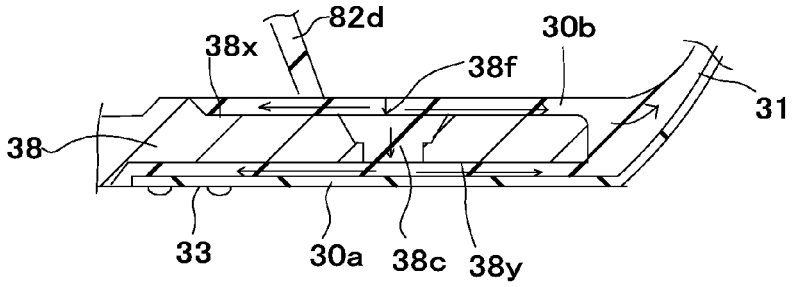
FIG. 7 is an enlarged cross-sectional view of a portion of the second mold to form a crankcase-attaching part.

Moreover, as shown in FIGS. 5 and 7, the AEM material supplied from each of the injection gates 82*d* into the cavity 80 hits the outer surface 38*x* of the rigid plate 38 and changes its flow direction to a planar direction along the outer surface 38*x* of the rigid plate 38. While flowing along the outer surface 38*x* of the rigid plate 38, part of the AEM material enters the through holes 38*c* and flows around to a side of the inner surface 38*y*. The AEM material fast and widely spreads both on the outer surface 38*x* and on the inner surface 38*y* of the rigid plate 38 and fills up a portion of the cavity 80 to form the crankcase-attaching portion 33 in a short time. Thus, the portion of the cavity 80 to form the crankcase-attaching portion 33 is filled with the AEM material in a short time. Moreover, part of the AEM material flows in a radially inward direction in the planar direction of the rigid plate 38, enters the portion of the cavity 80 to form the connecting part 31, joins the AEM material which has flown in the lower direction of a corresponding receiving portion 34*d* of the other rigid plate 34, and forms the connecting part 31.

After filling up the entire cavity 80, the AEM material is vulcanized by temperature of the second mold 8, thereby forming the outer layer 30*b*. Then the upper mold 83 is removed and the sections of the outer mold 82 are slid in radially outward directions and the core 72 is removed from the lower mold 84. The boot seal 3 held by the mold surface 71*a* of the core 71 is removed from the core 71. Thus, the boot seal 3 is obtained.

As shown in FIG. 1, the boot seal 3 is a tubular seal member to be attached to the aforementioned VCR engine. The boot seal 3 reduces its diameter toward an axial center and is axially extendable. Therefore, the boot seal 3 can deform so as to follow relative movements of the cylinder block 1 and the crankcase 2 and airtightly seal between the cylinder block 1 and the crankcase 2.

The side of the inner surface of the boot body 30 is constituted by the inner layer 30*a* formed of fluorine-containing rubber. Fluorine-containing rubber has good resistance to heat, oil and chemicals. Therefore, even if the inner surface of the boot seal 3 is exposed to blowby gas, degradation of the boot seal 3 can be suppressed.

Moreover, the outer layer 30*b* of the boot body 30 is formed of an inexpensive material other than fluorine-containing rubber, i.e., an AEM material. Therefore, the amount of the fluorine-containing rubber used in the entire boot seal 3 is decreased and costs of the boot seal 3 can be kept low.

The cylinder-attaching part 32 and the crankcase-attaching part 33 have the rigid plates 34, 38, respectively. The cylinder-attaching part 32 having the rigid plate 34 therein and the crankcase-attaching part 33 having the rigid plate 38 therein attain higher rigidity and improve in strength of attachment to the cylinder block 1 or the crankcase 2.

Besides, the AEM material constituting the outer layer 30*b* has entered the through holes 34*c*, 38*c* in the rigid plates 34, 38. Owing to an anchoring effect of the AEM material having entered the through holes 34*c*, 38*c*, the rigid plates 34, 38 are firmly fixed to the outer layer 30*b*.

As shown in FIGS. 5, 6, in order to form the outer layer 30*b*, the inner layer 30*a* is inserted beforehand in the cavity 80 of the second mold 8, and then the AEM material is supplied from the injection gates 82*c*, 82*d* for forming the outer layer 30*b*. These injection gates 82*c*, 82*d* are located at positions opposing the rigid plates 34, 38 in the cavity 80 for forming the outer layer 30*b*. In injection molding the outer layer 30*b*, the AEM material supplied from the injection gates 82*c*, 82*d* into the cavity 80 hits the opposing portions 34*f*, 38*f* of the rigid plates 34, 38 which oppose the injection gates 82*c*, 82*d*. Upon hitting the opposing portions 34*f*, 38*f* of the rigid plates 34, 38, injection pressure of the AEM material is reduced or dispersed. Injection pressure which the inner layer 30*a* inserted in the cavity 80 receives from the AEM material is reduced. Therefore, positional displacement or tears of the inner layer 30*a* is prevented.

The AEM material supplied from the injection gates 82*c*, 82*d* flows around from the outer surfaces 34*x*, 38*x* to the inner surfaces 34*y*, 38*y* through the through holes 34*c*, 38*c* of the rigid plates 34, 38. Accordingly, both the outer surfaces 34*x*, 38*x* and the inner surfaces 34*y*, 38*y* of at least portions of the rigid plates 34, 38 having the through holes 34*c*, 38*c* are covered with the AEM material. Inner surfaces of portions of the outer layer 30*b* opposing the through holes 34*c*, 38*c* face the inner layer 30*a*. The inner layer 30*a* is pressed down by the AEM material which has flown around from the through holes 34*c*, 38*c* of the rigid plates 34, 38. Therefore, the inner layer 30*a* is held by the AEM material in a relatively early stage of injection for forming the outer layer 30*b*. Thus, the inner layer 30*a* is suppressed from being positionally displaced by injection pressure of the AEM material for forming the outer layer 30*b*.

The injection gates 82*c*, 82*d* are located in the portions of the outer layers opposing surfaces of the rigid plates 34, 38 except openings of the through holes 34*c*, 38*c*. Therefore, the AEM material injected from the injection gates 82*c*, 82*d* hits the surfaces of the rigid plates 34, 38 and flows along the outer surfaces 34*x*, 38*x* of the rigid plates 34, 38. After having reduced its injection pressure, the AEM material enters the through holes 34*c*, 38*c* in the rigid plates 34, 38. The AEM material under low pressure flows through the through holes 34*c*, 38*c* and goes into gaps between the inner surfaces 34*y*, 38*y* of the rigid plates 34, 38 and the inner layer 30*a*. The inner layer 30*a* is not positionally displaced or torn by the flow of the AEM material.

Here, as shown in FIG. 8, the plurality of through holes 34*c*, 38*c* are provided at some intervals in the circumferential directions of the rigid plates 34, 38. The intervals of the through holes 34*c*, 38*c* can be constant all around the rigid plates 34, 38. In the present embodiment, however, the intervals of the through holes 34*c*, 38*c* are small at adjacent portions 34*g*, 38*g* to the injection gates 82*c*, 82*d* and great at distant portions 34*h*, 38*h* from the injection gates 82*c*, 82*d* (for example, portions near corners). Since the AEM material flows at a smaller rate at the distant portions 34*h*, 38*h* than at the adjacent portions 34*g*, 38*g*, upon forming the through holes 34*c*, 38*c* at small intervals at the distant portions 34*h*, 38*h* of the rigid plates 34, 38, the AEM material can flow around relatively fast from the outer surfaces 34*x*, 38*x* to the inner surfaces 34*y*, 38*y* at the distant portions 34*h*, 38*h* of the rigid plates 34, 38. Accordingly, the entire cylinder-attaching part 32 and the entire crankcase-attaching part 34 including the distant portions 34*h*, 38*h* can be securely molded. Flows of the molten fluorine-containing rubber material join together at the distant portions 34*h*, 38*h*. Since the molten fluorine-containing material flows around relatively fast at the distant portions 34*h*, 38*h*, the inner layer 30*b* is suppressed from creasing. A similar effect can be obtained by making sizes of the through holes 34*c*, 38*c* at the distant portions 34*h*, 38*h* from the injection gates 82*c*, 82*d* great and those at the adjacent portions 34*g*, 38*g* to the injection gates 82*c*, 82*d* small.

As shown in FIG. 7, the through holes 38*c* formed in the rigid plate 38 have a larger diameter, i.e., wider openings near the outer surface 38*x* than near the inner surface 38*y*. This configuration facilitates the AEM material to enter the through holes 38*c* from the outer surface 38*x* and flow around fast into a very small gap of about 1 mm between the inner surface 38*y* of the rigid plate 38 and the inner layer 30*a*.

The AEM material having flown around to the sides of the inner surfaces 34*y*, 38*y* of the rigid plates 34, 38 through the through holes 34*c*, 38*c* presses down the inner layer 30*a* against the mold surface 71*a* of the core 71. The inner layer 30*a* is not positionally displaced by the flow of the AEM material.

The outer peripheral portion of the rigid plate 34 fixed to the cylinder-attaching part 32 has the receiving portions 34*d* bent toward the connecting part 31. The injection gates 82*c* for the outer layer 30*b* are located at portions of the outer layer 30*b* opposing the opposing portions 34*f* of the receiving portions 34*d* formed at the outer peripheral portion of the rigid plate 34. The AEM material supplied from the injection gates 82*c* hits the opposing portions 34*f* of the receiving portions 34*d*. One part of this AEM material flows along the rigid plate 34 and forms the cylinder-attaching part 32. The other part of the AEM material flows toward the connecting part 31. Flow rate of the AEM material flowing into the portion of the cavity 80 to form the cylinder-attaching part 32 and flow rate of the AEM material flowing into the portion of the cavity 80 to form the connecting part 31 can be controlled by adjusting the direction or angle of the receiving portions 34*d* with respect to the connecting part 31. Thus, the AEM material supplied from the injection gates 82*c* can fill the entire cavity 80 fast and uniformly.

Upon formed by injection molding, the inner layer 30*b* attains a thin tear-free film shape. The boot seal 3 is suppressed from degradation due to blowby gas, and costs of the boot seal 3 can be reduced.

In forming the inner layer 30*a*, the mold surface 71*a* of the core 71 has the uneven portion 71*b*. An uneven portion 30*d* having a shape in conformity with a shape of the uneven portion 71*b* is formed on the inner surface of the inner layer 30*a*. When the inner layer 30*a* is inserted in the cavity 80 of the second mold 8 and the AEM material is injected, the uneven portion 30*d* of the inner layer 30*a* prevents positional displacement of the inner layer 30*a* with respect to the mold surface 71*a* of the core 71. Therefore, the inner layer 30*a* is securely prevented from creasing or tearing.

In the present embodiment, a portion of the mold surface 84*a* of the lower mold 84 of the second mold 8 to form the connecting part 31 has no uneven portion. However, owing to the uneven portion 74*b* of the mold surface 74*a* of the lower mold 74 of the first mold 7, the uneven portion 30*d* has been formed on a portion of the inner surface of the inner layer 30*a* which comes in contact with the portion of the mold surface 84*a* of the lower mold 84 to form the connecting part 31. This uneven portion 30*d* prevents flows of the AEM material from causing positional displacement of the inner layer 30*a*. Note that the portion of the mold surface 84*a* of the lower mold 84 of the second mold 8 to form the connecting part 31 can have an uneven portion.

Not the mold surface 71*a* of the core 71 and the mold surface 74*a* of the lower mold 74 of the first mold 7 for forming the inner layer 30*b* but the mold surface 84*a* of the lower mold 84 of the second mold 8 for forming the outer layer 30*a* can have an uneven portion. In this case, an uneven portion is not formed on the inner surface of the inner layer 30*a*, but an engagement in contact of the inner surface of the inner layer 30*a* with the uneven portion of the mold surface 84*a* of the lower mold 84 of the second mold 8 prevents positional displacement of the inner layer 30*a*.

Figure 9:
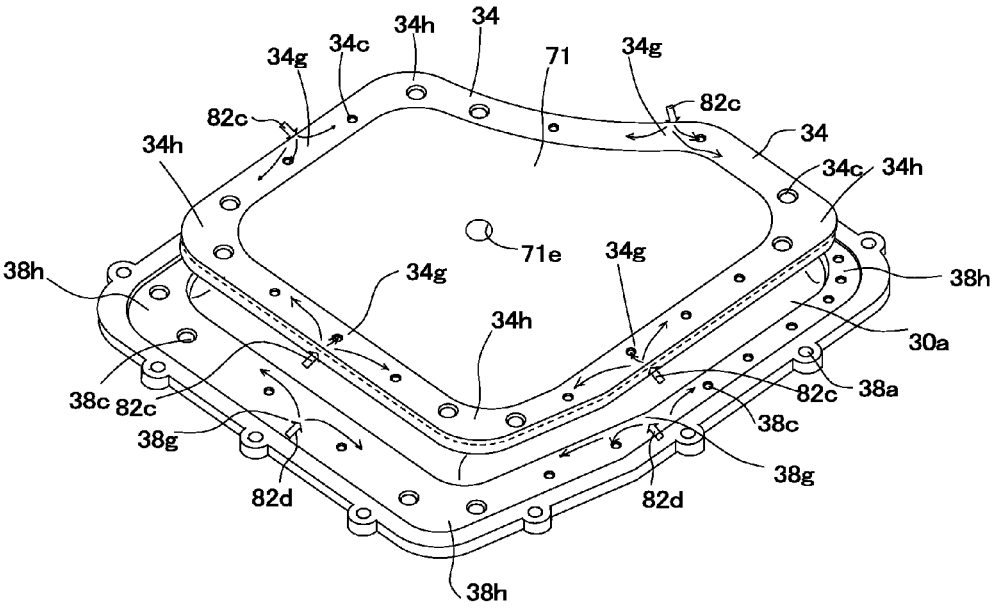
FIG. 9 is a perspective view of rigid plates of a boot seal as a modification of those of FIG. 8 fixed to a core.

In order to make the AEM material flow around relatively fast at the distant portions 34*h*, 38*h* of the rigid plates 34, 38, as shown in FIG. 8, intervals of the through holes 34*c*, 38*c* at the distant portions 34*h*, 38*h* are made smaller than those at the adjacent portions 34*g*, 38*g* in the present embodiment. As shown in FIG. 9, however, sizes of the through holes 34*c*, 38*c* at the distant portions 34*h*, 38*h* can be made greater than those at the adjacent portions 34*g*, 38*g*.

Second Preferred Embodiment

Figure 10:
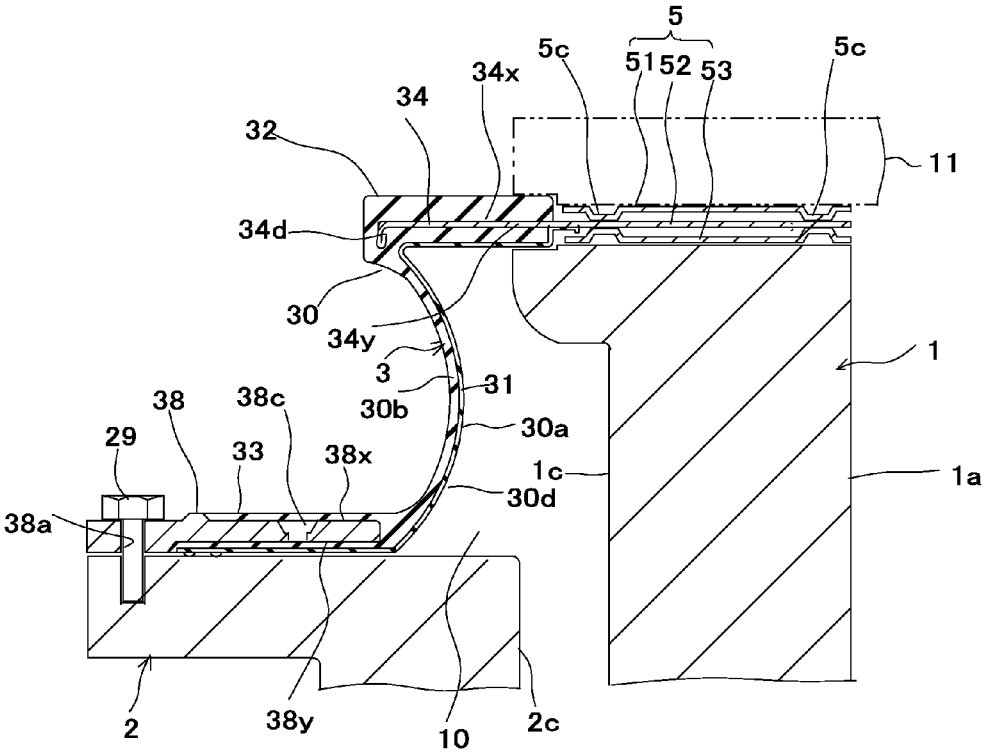
FIG. 10 is a cross-sectional view of a boot seal for a VCR engine according to a second preferred embodiment of the present invention.

In a boot seal of the present embodiment shown in FIG. 10, a rigid plate 34 disposed in a cylinder-attaching part 32 is integrally formed with a cylinder head gasket 5. The cylinder head gasket 5 has a three-layer structure comprising a stack of an outer metal plate 51, a middle metal plate 52 and an inner metal plate 53. The rigid plate 34 of the cylinder-attaching part 32 is integrally formed as an extension of an outer peripheral portion of the middle metal plate 52 of the cylinder head gasket 5. Other structural features of the boot seal 3 of the present embodiment are the same as those of the first preferred embodiment.

In the present embodiment, too, injection gates 82*c*, 82*d* for the outer layer 30*b* are located at portions of the outer layer 30*b* opposing the rigid plate 34 and a rigid plate 38, respectively. Since an AEM material spreads into every portion of outer surfaces 34*x*, 38*x* and inner surfaces 34*y*, 38*y* of the rigid plates 34, 38 by flowing through through holes 34*c*, 38*c* formed in the rigid plates 34, 38, the outer surfaces 34*x*, 38*x* and the inner surfaces 34*y*, 38*y* of the rigid plates 34, 38 are covered with the outer layer 30*b*. Thus, the boot seal 3 for a VCR engine having an inner layer 30*a* free from tears or creases is obtained.

Third Preferred Embodiment

Figure 11:
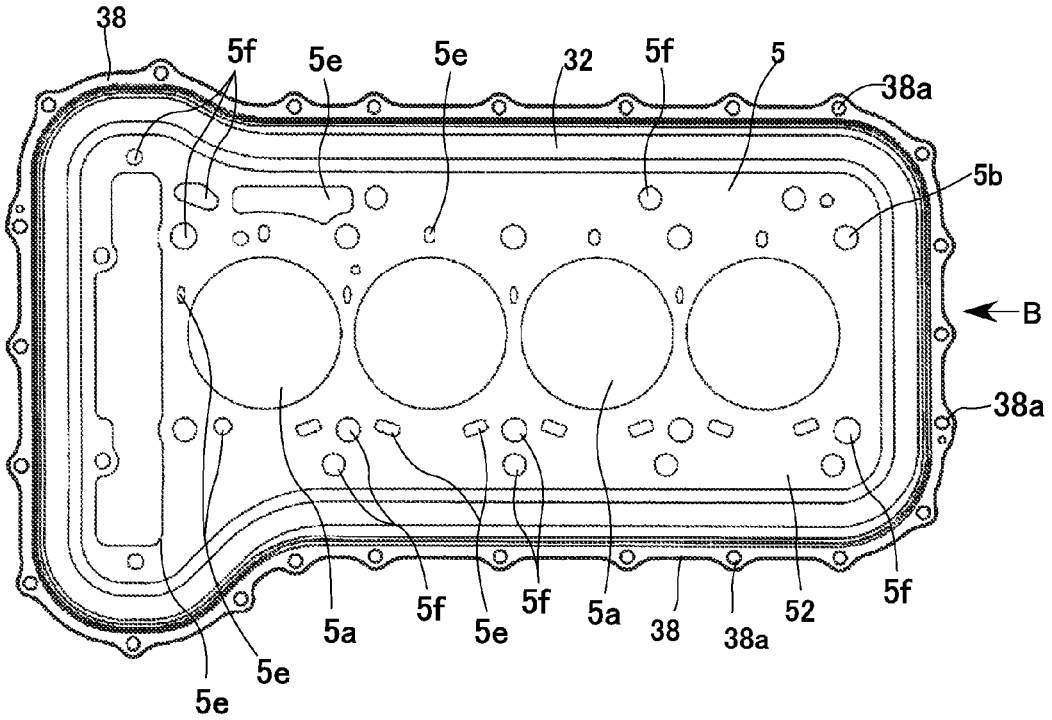
FIG. 11 is a plan view of a boot seal integrally formed with a cylinder head gasket for use with a VCR engine according to a third preferred embodiment of the present invention.
Figure 12:
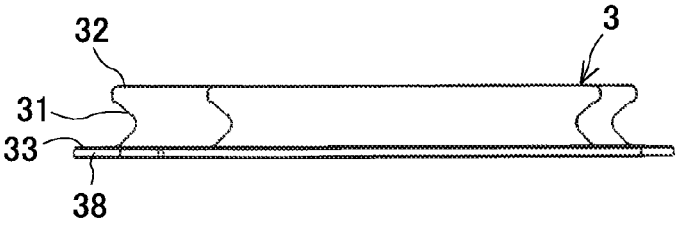
FIG. 12 is a side view of the boot seal according to the third preferred embodiment of the present invention in the direction of the arrow B in FIG. 11.

A boot seal according to the present embodiment is attached to a four-cylinder VCR engine, as shown in FIGS. 11, 12. A cylinder block of the engine has four cylindrical parts arranged in series. A cylinder head gasket 5 covering an upper portion of the engine has piston openings 5*a* of the same number as that of the cylindrical parts of the cylinder block, bolt holes 5*b* for bolting the cylinder block, the boot seal 3 and the cylinder head, water holes 5*e* for cylinder-surrounding components of an engine cooling system, and oil holes 5*f* for cylinder-surrounding components of a lubricating oil system.

The cylinder gasket 5 has a three-layer structure comprising a stack of an outer metal plate, not shown, a middle metal plate 52 and an inner metal plate, not shown. A rigid plate, not shown, of a cylinder-attaching part 32 is integrally formed as an extension of an outer peripheral portion of the middle metal plate 52 of the cylinder head gasket. Other structural features of the boot seal 3 of the third preferred embodiment are the same as those of the second preferred embodiment.

In the above embodiments, the rigid plates 34, 38 are provided in the cylinder-attaching part 32 and a crankcase-attaching part 33, respectively. However, it is possible to provide only one rigid plate 34 or 38 in the cylinder-attaching part 32 or the crankcase-attaching part 33.

When the rigid plates 34, 38 are respectively provided in the cylinder-attaching part 32 and the crankcase-attaching part 33, both the rigid plates 34, 38 can have the through holes 34*c*, 38*c* as in the above embodiments, but only one of the rigid plates 34, 38 can have through holes 34*c* or 38*c*.

Obviously, many modifications and variations of the present invention are possible in the light of the above teachings. It is therefore to be understood that within the scope of the appended claims, the invention may be practiced otherwise than as specifically described.

What is claimed is:

1. A boot seal, for use with a variable compression ratio engine capable of varying volume of a combustion chamber by changing relative positions of a cylinder block and a crankcase, attached to the variable compression ratio engine, and covering a gap between the cylinder block and the crankcase, comprising:

a boot body having a cylinder-attaching part to be fixed to the cylinder block, a crankcase-attaching part to be fixed to the crankcase, and a connecting part for connecting the cylinder-attaching part and the crankcase-attaching part; and a rigid plate that is disposed in at least one of the cylinder-attaching part and the crankcase-attaching part, that has a through hole, and that includes a peripheral portion including a receiving portion bent toward the connecting part of the boot body, wherein the boot body comprising an outer layer formed by injection molding a rubber material, and an inner layer disposed inside the outer layer and formed of fluorine-containing rubber, an injection gate scar that is formed on the outer layer of the boot body, that faces the receiving portion of the rigid plate, and that is located at a portion of the outer layer opposing the receiving portion of the rigid plate, and both an outer surface and an inner surface of at least a portion of the rigid plate having the through hole being covered with the rubber material supplied from an injection gate, wherein the rigid plate further comprises a distant portion spaced apart from the injection gate scar and an adjacent portion spaced closer to the injection gate scar than the distant portion, and the through hole is a plurality of through holes arranged in a circumferential direction of the rigid plate, and the through holes are spaced apart at closer intervals at the distant portion than at the adjacent portion.

2. The boot seal according to claim 1, wherein the injection gate scar is located in the portion of the outer layer opposing a surface of the rigid plate except an opening of the through hole.

3. The boot seal according to claim 1, wherein an inner surface of a portion of the outer layer facing the through hole of the rigid plate contacts the inner layer.

4. The boot seal according to claim 1, wherein an inner surface of the inner layer has an uneven portion.

5. A boot seal, for use with a variable compression ratio engine capable of varying volume of a combustion chamber by changing relative positions of a cylinder block and a crankcase, attached to the variable compression ratio engine, and covering a gap between the cylinder block and the crankcase, comprising:

a boot body having a cylinder-attaching part to be fixed to the cylinder block, a crankcase-attaching part to be fixed to the crankcase, and a connecting part for connecting the cylinder-attaching part and the crankcase-attaching part; and a rigid plate that is disposed in the crankcase-attaching part and that includes a through hole, an inner peripheral portion, and an outer peripheral portion attached to a portion of the outer layer surrounding the crankcase-attaching part, the inner peripheral portion of the rigid plate is located at an inner peripheral portion of the portion of the outer layer surrounding the crankcase-attaching part, the outer peripheral portion of the rigid plate protrudes in an outward direction out of an outer peripheral portion of the portion of the outer layer surrounding the crankcase-attaching part so that the outer peripheral portion of the rigid plate is configured to attach to the crankcase and includes a fixed portion that fixes to the crankcase, the boot body comprising an outer layer formed by injection molding a rubber material, and an inner layer disposed inside the outer layer and formed of fluorine-containing rubber, an injection gate, scar that is formed on the outer layer of the boot body and that is located at a portion of the outer layer opposing the rigid plate, and both an outer surface and an inner surface of at least a portion of the rigid plate having the through hole being covered with the rubber material supplied from an injection gate.

6. The boot seal according to claim 5, wherein the rigid plate is fixed to the crankcase.

7. A boot seal, for use with a variable compression ratio engine capable of varying volume of a combustion chamber by changing relative positions of a cylinder block and a crankcase, attached to the variable compression ratio engine, and covering a gap between the cylinder block and the crankcase, comprising: a boot body having a cylinder-attaching part to be fixed to the cylinder block, a crankcase-attaching part to be fixed to the crankcase, and a connecting part for connecting the cylinder-attaching part and the crankcase-attaching part; and the rigid plate disposed in at least one of the crankcase-attaching part and the cylinder-attaching part, and having a through hole, the boot body comprising an outer layer formed by injection molding a rubber material, and an inner layer disposed inside the outer layer and formed of fluorine-containing rubber, an injection gate scar that is formed on the outer layer of the boot body, and that is located at a portion of the outer layer opposing the rigid plate, and both an outer surface and an inner surface of at least a portion of the rigid plate having the through hole being covered with the rubber material supplied by the injection molding, wherein the rigid plate further comprises a distant portion spaced apart from the injection gate scar and an adjacent portion spaced closer to the injection gate scar than the distant portion, and the through hole is a plurality of through holes arranged in a circumferential direction of the rigid plate, and the through holes are spaced apart at closer intervals at the distant portion than at the adjacent portion.

8. The boot seal according to claim 5, wherein the rigid plate further comprises a distant portion spaced apart from the injection gate scar and an adjacent portion spaced closer to the injection gate scar than the distant portion, and the through hole is a plurality of through holes arranged in a circumferential direction of the rigid plate, and diameters of the through holes are larger at the distant portion than at the adjacent portion.

9. The boot seal according to claim 5, wherein the through hole has a diameter that is larger at the outer surface of the rigid plate than at the inner surface of the rigid plate.

10. The boot seal according to claim 5, wherein the inner layer of the boot body further comprises an inner surface and an uneven portion formed on the inner surface.

11. The boot seal according to claim 1, wherein diameters of the through holes are larger at the distant portion than at the adjacent portion.

12. The boot seal according to claim 1, wherein the through hole has a diameter that is larger at the outer surface of the rigid plate than at the inner surface of the rigid plate.

13. The boot seal according to claim 1, wherein the inner layer of the boot body further comprises an inner surface and an uneven portion formed on the inner surface.

* * * * *